United States Patent [19]

Ahonen

[11] Patent Number: 4,532,413

[45] Date of Patent: Jul. 30, 1985

[54] STEAM GENERATOR HEATED BY COMBINATION OF ELECTRIC HEAT AND CONDENSATION OF CONTAMINATED PROCESS STEAM

[75] Inventor: Heikki Ahonen, Valkeakoski, Finland

[73] Assignee: Yhtyneet Paperitehtaat Oy, Valkeakoski, Finland

[21] Appl. No.: 434,847

[22] Filed: Oct. 18, 1982

[30] Foreign Application Priority Data

May 4, 1982 [FI] Finland ..... 821565

[51] Int. Cl.[3] ..... D21F 5/20; F22B 1/16; F22B 1/30; H05B 3/60

[52] U.S. Cl. ..... 219/279; 122/4 A; 122/7 R; 122/7 B; 162/47; 219/272; 219/273; 219/275; 219/285; 219/286

[58] Field of Search ..... 219/284–295, 219/279, 271–276; 162/47, 239; 122/7 B, 7 R, 13 A, 4 A

[56] References Cited

U.S. PATENT DOCUMENTS

| | | | |
|---|---|---|---|
| 1,407,717 | 2/1922 | Witte | 122/7 B |
| 1,650,632 | 11/1927 | Kowallik | 219/284 X |
| 1,665,793 | 4/1928 | Sandborgh | 219/286 |
| 1,937,059 | 11/1933 | Fountain | 219/279 |
| 4,231,842 | 11/1980 | Ojala | 162/47 |

FOREIGN PATENT DOCUMENTS

| | | | |
|---|---|---|---|
| 144441 | 1/1936 | Austria | 219/286 |
| 451847 | 10/1948 | Canada | 219/286 |
| 491158 | 8/1938 | United Kingdom | 122/7 B |
| 613349 | 11/1948 | United Kingdom | 219/285 |

*Primary Examiner*—A. Bartis

*Attorney, Agent, or Firm*—Birch, Stewart, Kolasch & Birch

[57] ABSTRACT

A steam generator assembly, particularly for use in connection with the mechanical preparation of pulp, for generating pure steam required in a subsequent process, such as drying of proper in a paper machine, by utilizing the condensation heat of contaminated steam coming from a preceding process, such as a grinding process, includes a steam converter and electrical boiler arranged in a common housing to form a unified structure. The steam converter utilizes the condensation heat of the contaminated steam to generate pure steam from water supplied to the converter. The electric boiler is connected in parallel to the steam converter and includes electrodes adapted to generate steam when moistened by water supplied to the boiler from a separate water container in the housing. Selective control of the supply of water to the electric boiler and the extent to which the electrodes are moistened regulates the amount of pure steam generated by the electric boiler. The pure steam generated by the steam converter and electric boiler is discharged from the common housing through a steam outlet.

6 Claims, 2 Drawing Figures

STEAM GENERATOR HEATED BY COMBINATION OF ELECTRIC HEAT AND CONDENSATION OF CONTAMINATED PROCESS STEAM

BACKGROUND AND SUMMARY OF THE INVENTION

The present invention concerns a stream generator, in particular a steam generator used in connection with the mechanical preparation of pulp, for generating pure steam required in a subsequent process, e.g., in the drying of paper in a paper machine, by utilizing the condensation heat of contaminated steam coming from a preceding process, e.g., a grinding process.

When wood chips are being ground by means of the so-called thermomechanical process (TMP) of prior art, wherein the wood chips are most usually introduced into a 1-phase or 2-phase system of a disc grinder, electrical energy is typically consumed at a rate of about 1.7 to 2.5 MWh per ton of ready paper pulp.

In such processes, whose efficiency is, according to literature references, 0.1 to 0.2%, almost all of the rest of the energy is recovered out of the process in the form of steam. In an integrated paper mill, this steam can be converted in a heat exchanger into pure steam and be used in the paper machine for drying the paper. The steam obtained in this way represents 50 to 75% of the steam consumed by a paper machine.

Such a process is now already in operation in many places around the world. A problem that remains is that, out of a TMP plant, quite varying quantities of steam are obtained to the paper machine, because these quantities depend on the degree of utilization of the grinders. In such a situation, if, for example, a grinding line, whose output may be of the order of 10 to 15 MW, falls off, a corresponding quantity of steam also becomes unavailable to the paper machine. In such a case, the power plant producing auxiliary steam must react to the altered situation rapidly.

Today, in many parts of the world, the costs of electricity and fuel oil are rather close to each other and, moreover, often the marginal cost of electricity is still closer to the cost of the heat equivalent of fuel oil than the average cost of electricity.

When a large grinding line is being started, said line having, e.g., two grinders in series and having a total output of the order of 10 to 15 MW, the grinders are loaded evenly while increasing the output continuously over 2 to 20 minutes, whereby steam, which is generated correspondingly, is obtained in proportion to the loading.

It is also possible to combine a steam generator in which contaminated TMP steam is converted into pure steam with an electrical boiler which compensates for the output of grinders falling off. Such a boiler goes on with the same total electricity load while using part of its power for producing pulp and part for direct steam generation in the steam generator.

In this procedure as well, there remains the problem that power cannot be shifted suddenly from the grinders to electricity-consuming and steam-producing electrodes without causing a violent fluctuation in the electricity supply network.

Now it has been noticed that, in such a steam converter, in which part of the power is produced by means of power electrodes, the above-discussed difficulties can be overcome surprisingly easily in the way to be indicated below.

The invention is based on the idea that the overall generation of steam is equalized by controlling the moistening area of the electrodes in the electrical boiler. More specifically, the steam generator in accordance with the present invention is characterized in that it comprises

- a steam converter;
- an electrical boiler connected in parallel with the steam converter;
- at least one power electrode arranged within the electrical boiler and comprising an outer face;
- means for moistening the outer face of said at least one electrode; and
- means for controlling the moistening area of the outer face of said at least one electrode.

BRIEF DESCRIPTION OF THE DRAWINGS

The invention will be examined below in more detail with the aid of the examples in accordance with the attached drawings.

DETAILED DESCRIPTION OF THE INVENTION

Figure 1:
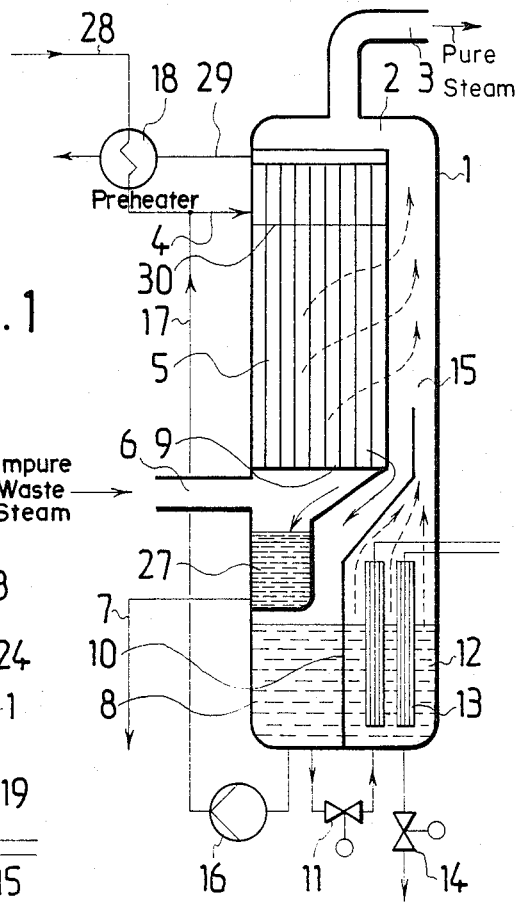
FIG. 1 is a schematical sectional view of a first assembly consisting of a steam converter, of a separate water container, and of an electrical boiler.
Figure 2:
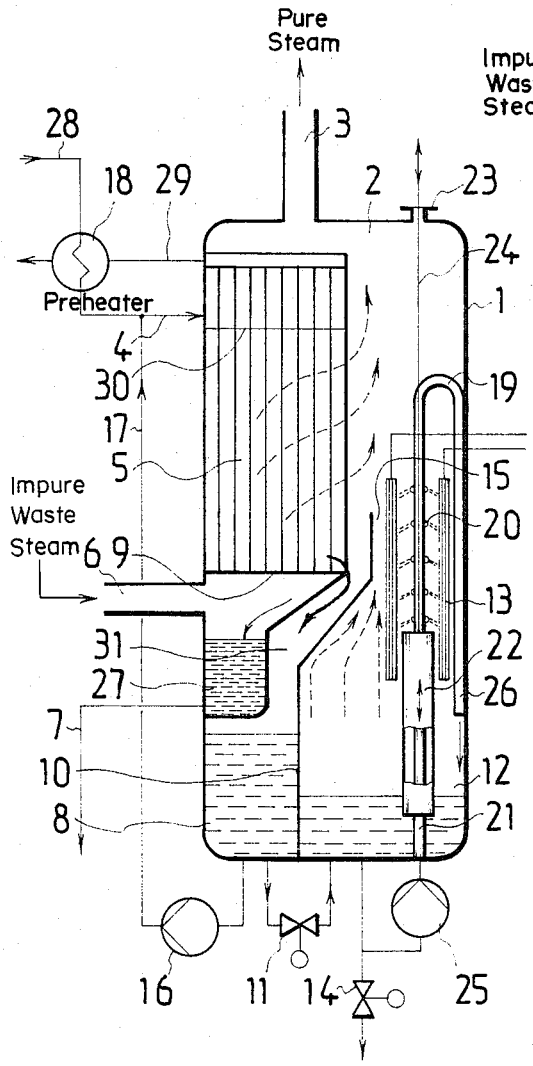
FIG. 2 is a schematical sectional view of a second assembly, in which the electrical boiler has been accomplished by means of the jet principle.

As illustrated in FIGS. 1 and 2, a housing 1 of unified structure is provided with an outlet pipe 3 for delivering pure steam. An inlet pipe 4 is operatively connected to the housing 1 for supplying feed water. In addition, an inlet pipe 6 is provided for supplying impure waste steam. A steam converter 5 having a bottom 9 is positioned within the housing 1. A feed pump 16 supplies water from a container 8 positioned within the housing 1 to an inlet pipe 4. Further, a feed pump 25 (see FIG. 2) is provided for supplying water from a bottom portion of the electric boiler 12 to a jet pipe 21.

Let us assume that the steam converter 5 (FIG. 1) receives contaminated steam from TMP grinders of from any other process of mechanical pulp production, e.g., as a quantity corresponding to an output of 30 MW and, at the same time, the electric boiler 12 generates additional steam by means of electrodes 13 within the electric boiler 12 of the pure steam generator assembly comprising steam converter 5 and the electric boiler 12 located in housing 1 and providing a unified structure, e.g., at a rate of 15 MW. Let as assume further that more grinders are started at this power of 15 MW and that the starting takes place, e.g., during 3 minutes. Now the situation is arranged such that, out of the electrical boiler 12 in which the electrodes 13 are placed, water is pumped out, or allowed to flow out by means of the system's own pressure, from between the electrodes through the valve 14 as the grinders are taking more power, so that this additional power increases as much as the electrode power is reduced. In such a case, e.g., a paper machine using steam always, even as the grinders are being started, receives the same quantity of steam. When the grinders are under full load, the electrical boiler 12 is empty, having no water around the electrodes 13, and no steam is generated directly electrically. On the other hand, when grinders start being run down, the water level in the electrical boiler 12 is raised accordingly so that the power dropped off from the grinders is again shifted to the electrodes 13 and is directly converted into a corresponding quantity of pure steam.

The electrical boiler 12 is connected in parallel with the steam converter 5, and is provided with two electrodes 13 extending vertically. Moreover, it is provided with an inlet valve 11 and an outlet valve 14, by means of which the water level in the electrode space of the electrical boiler 12 can be controlled so that the total output of the pure steam generator assembly comprising the electrical boiler 12 and of the steam converter 5 can be maintained at a desired level, e.g., as of constant magnitude, irrespective of variations in the impure steam output coming from the grinder to the steam converter 5. In the example case, the electrode space of the electrical boiler 12 is connected via the inlet valve 11 to a separate water container 8. This water container 8 may be in direct feed connection with the heat transfer face 9 of the steam converter 5 by pump 16 and separated from the electrode space of the electrical boiler 12 by means of a partition wall 10. The steam space of the electrical boiler 12 bypasses the steam converter 5 via a channel 15 and is directly connected with the steam space 2 of the housing 1 enclosing the steam converter 5 of the electrical boiler 12 of the pure steam generator assembly. The separate water container 8 is preferably high enough so that the water contained therein may move into the electrical boiler 12 via the inlet valve 11 by the effect of gravitation. Alternatively, this movement of water may be arranged by means of a pump.

The solution shown in FIG. 2 differs from that shown in FIG. 1 in the respect that therein the electrical boiler 12 includes a jet device 20 to 26, by means of which the vertical electrodes 13 can be moistened. The jet device comprises a stationary, vertical jet pipe 21, 19, which is fitted between the electrodes 13 and which is supplied by the pump 25. The jet pipe 21, 19 is provided with nozzles 20, by means of which the inside faces the electrodes 13 can be sprayed with water. Between the electrodes 13 and the jet pipe 21, 19, a covering means 22 is fitted, which can be shifted vertically by means of a lifting wire 24 and which, when facing the jet, prevents the jet from hitting against the electrode 13. Thus, the control takes place by varying the height of the covering means 22.

Within the scope of the invention, it is also possible to conceive solutions differing from the exemplifying embodiment described above (FIG. 1). Thus, the inlet and outlet valve may also be a single joint valve through which water can be shifted by means of a pump between the water container 8 and the electrical boiler 12 in both directions. The control proper, i.e., the opening and closing of the valves 11 and 14 is most appropriately operated by means of a computer in a way known per se. Differing from the example, the electrical boiler 12 may also be separate and, e.g., by means of a pipe, connected to the steam space 2 of the housing 1.

As a more detailed description related to the drawings, it should be mentioned that a container 27 for contaminated condensate, an outlet pipe 7 for contaminated condensate, a supply pipe 17 for circulation water, and a sealing means 23 for the lifting wire 24 are provided. In addition, a return pipe 26 for the jet device, a supply water pipe 28, a preheater 18 for supply water and an exhaust pipe 29 for inert gases are provided. Further, a liquid distributor disk 30 of the steam converter and a return channel 31 for condensate are illustrated in FIG. 2.

Finally, it should be stated that a solution in which electrical power is shifted between grinders and the electrical boiler by altering the liquid level in the electrode space is an alternative for the possibility that the shifting of the same electrical power takes place by means of switches.

What is claimed is:

1. A steam generator assembly, in particular a steam generator assembly used in connection with the mechanical preparation of pulp, for generating pure steam required in a subsequent process, such as in a drying of paper in a paper machine, by utilizing the condensation heat of contaminated steam coming from a preceding process, such as a grinding process, comprising:

a steam converter;

means for supplying water to be converted to pure steam to said steam converter;

means for supplying contaminated steam to said steam converter;

said steam converter utilizing the condensation heat of the contaminated steam from a process producing contaminated steam for generating pure steam;

an electrical boiler connected in parallel with the steam converter for generating pure steam independently of said steam converter;

at least one electrically energizable power electrode arranged within the electrical boiler, said at least one electrode adapted to generate steam when electrically energized and moistened and each electrode comprising an outer face;

means for supplying water to the electrical boiler for selectively moistening the outer face of said at least one electrode to generate pure steam therein; and means for selectively controlling said water supplying means and the extent of the moistened area of the outer face of said at least one electrode and thereby the amount of pure steam generated by the electrical boiler;

a common housing including a pure steam outlet in operative communication for receiving pure steam from an outlet of the steam converter and the electrical boiler;

wherein the steam converter and the electrical boiler are arranged within said common housing so as to form a unified structure.

2. A steam generator assembly according to claim 1, and said means for supplying water to said electrical boiler comprises a separate water container and an inlet valve connecting said container to the electrical boiler.

3. A steam generator assembly according to claim 2, wherein the water container is directly connected with a heat-transfer face of the steam converter.

4. A steam generator assembly according to claim 2, and further comprising said separate water container being located within said common housing and a partition wall within said common housing for separating the electrical boiler from the separate water container.

5. A steam generator assembly according to claim 2, wherein the pure steam outlet of the electrical boiler has a direct connection with the steam space of the steam converter.

6. A steam generator assembly according to claim 2, wherein the separate water container is high enough so that the water contained therein may move into the electrical boiler via an inlet valve by the effect of gravitation.

* * * * *